US007097319B2

(12) United States Patent
Mauk et al.

(10) Patent No.: US 7,097,319 B2
(45) Date of Patent: Aug. 29, 2006

(54) LIGHTING FIXTURE

(75) Inventors: Andrew J. Mauk, Milwaukee, WI (US); Andrew W. Shabica, Cedarburg, WI (US); Robert T. Allen, Green Bay, WI (US)

(73) Assignee: SPI Lighting, Inc., Mequon, WI (US)

( * ) Notice: Subject to any disclaimer, the term of this patent is extended or adjusted under 35 U.S.C. 154(b) by 157 days.

(21) Appl. No.: 10/799,519

(22) Filed: Mar. 12, 2004

(65) Prior Publication Data

US 2005/0201082 A1 Sep. 15, 2005

(51) Int. Cl.
*F21S 8/00* (2006.01)

(52) U.S. Cl. ..... 362/147; 362/238; 362/249; 362/432

(58) Field of Classification Search ..... 362/147, 362/238, 249, 250, 371, 432
See application file for complete search history.

(56) References Cited

U.S. PATENT DOCUMENTS

| | | | | |
|---|---|---|---|---|
| 881,284 | A * | 3/1908 | Atkinson | 439/209 |
| 2,793,286 | A * | 5/1957 | Stiffel | 362/431 |
| 3,096,029 | A | 7/1963 | Berge | |
| 5,615,946 | A * | 4/1997 | Yeh | 362/250 |
| 5,816,687 | A * | 10/1998 | Tapp | 362/250 |
| 6,149,280 | A * | 11/2000 | Quiogue et al. | 362/147 |
| 6,318,880 | B1 * | 11/2001 | Siminovitch et al. | 362/225 |
| 6,422,720 | B1 * | 7/2002 | Fischer et al. | 362/374 |
| 6,494,601 | B1 * | 12/2002 | Johnson | 362/406 |
| 6,860,619 | B1 * | 3/2005 | Swanson | 362/250 |

OTHER PUBLICATIONS

SPI Lighting Inc.; SPC; catalog; dated 1991; page pp. 192-193; Mequon, Wisconsin.
SPI Lighting Inc.; Echo Series, Wall Bracket; catalog; dated 1992; page pp. 392-31A; Mequon, Wisconsin.
SPI Lighting Inc.; Option Series, Wall/Ceiling Mount; catalog; dated 1992; page pp. 392-50; Mequon, Wisconsin.

* cited by examiner

*Primary Examiner*—Thomas M. Sember
*Assistant Examiner*—Adam C. Rehm
(74) *Attorney, Agent, or Firm*—Quarles & Brady LLP

(57) ABSTRACT

A lighting fixture is disclosed that has two lights sandwiching a pivotable reflector. An upwardly directed lamp is mounted on the reflector to pivot therewith. The down lamp may also be mounted on the reflector to pivot therewith, albeit it need not be. A lower shade can enclose the down lamp. To replace the lower lamp one can pivot the reflector to provide access to the burnt-out lamp.

11 Claims, 8 Drawing Sheets

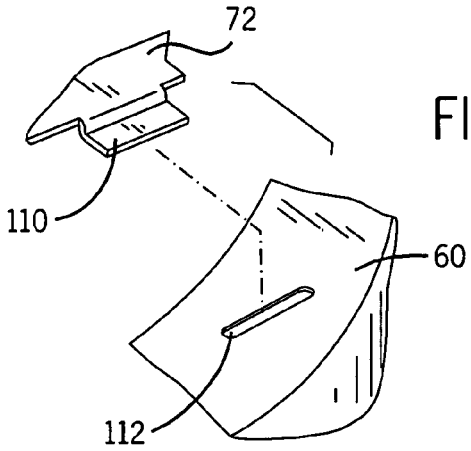
FIG. 3A
FIG. 5
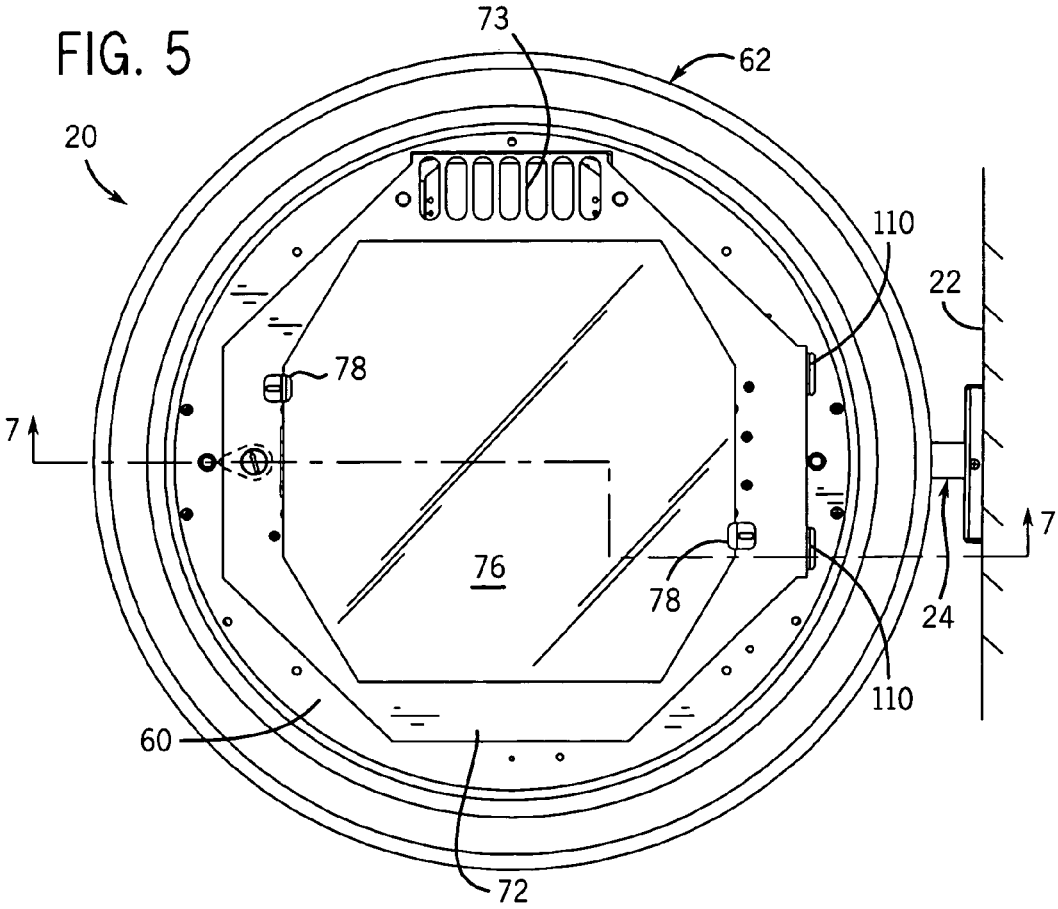

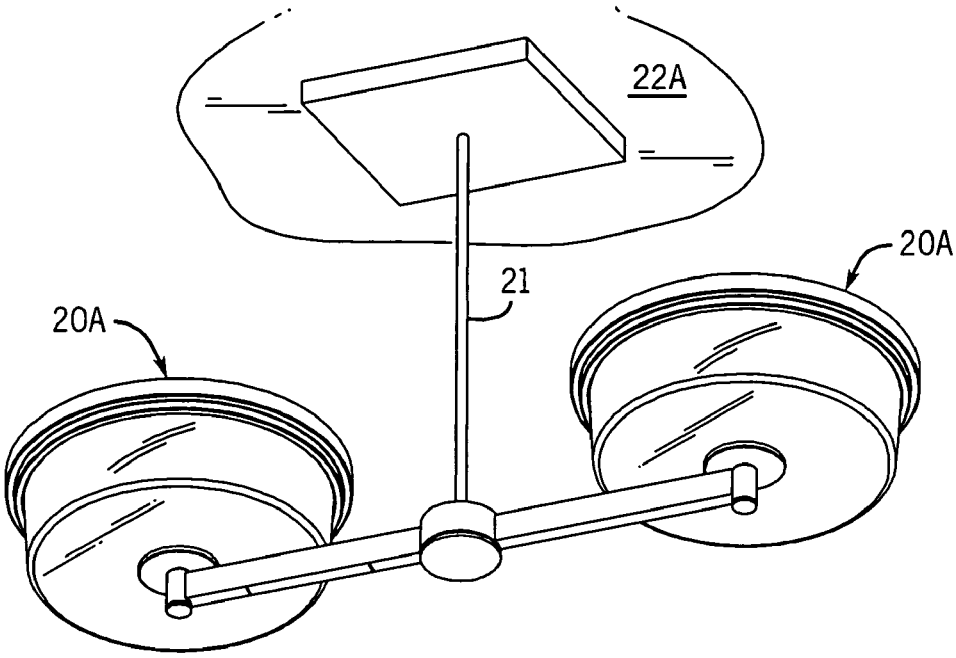
FIG. 12
FIG. 13
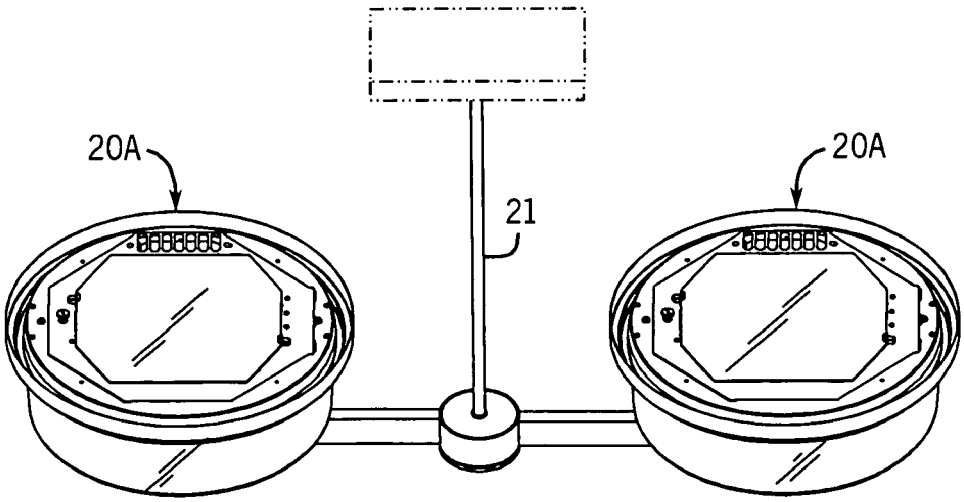

LIGHTING FIXTURE

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to mountable lighting fixtures (e.g., on a ceiling, a vertical wall or a horizontal surface), and in particular to such lighting fixtures that are designed to permit easier maintenance access.

A wide variety of wall mounted lighting units are known. Some of these, such as chandeliers, are hung from the ceiling. Others, such as wall mounted sconces, extend outward and then upward from a vertical room wall.

Numerous considerations go into optimizing such lighting fixtures. Such fixtures must, of course, project light in a desired manner, and at a desired intensity. However, they should also preferably present a highly ornamental appearance without excessive glare.

Further, such fixtures must be of solid construction, be relatively inexpensive to manufacture, and where low enough to the ground be tamper resistant. Also, such devices should preferably have low energy usage for the degree of light projected.

Apart from this array of standard considerations, one also needs to consider that most such devices use incandescent or fluorescent lamps to project light. While the durable life of such lamps can be quite long in some cases, most such lamps will periodically need to be replaced when they burn out. When a particular building has numerous such lamps, the time spent in replacing burnt out lamps can be significant.

U.S. Pat. No. 6,318,880 is a lighting fixture having a horizontally disposed two-sided reflector. A pair of fluorescent lights are mounted above and below the reflector so that light is projected both up and down in a controllable manner. Because the unit is a table or floor lamp the lamps can readily be reached for replacement by someone standing next to the lamp.

While this design has some advantages as a floor or table lamp design, it suffers from leaving the fluorescent lamps exposed to vandalism. Further, someone directly underneath the lamp might be exposed to an undesirable glare.

Another type of known lighting fixture is taught in U.S. Pat. No. 3,096,029. That unit is for a street light and is provided with a lower transparent bowl above which is mounted a lamp. When the lamp burns out, or there is other need for access to the interior of the fixture, the lamp and bowl can be swung down as a unit to provide access to the lamp and fixture interior. However, this design is set up to project light downward (and not upward), and is somewhat exposed to the risk of vandalism.

Thus, a need still exists for a light fixture that can project light in opposite directions without undesired glare in the downward direction, of undue risk of vandalism, yet provides easy access for maintenance.

SUMMARY OF THE INVENTION

The invention provides a lighting fixture having a fixture support, a shade supported by the fixture support, a first lamp receiver positioned adjacent the shade so that light can be projected beyond the shade if a lamp is placed in the first lamp receiver and that lamp is supplied with power, a pivotable wall positioned over the first lamp receiver, and a second lamp receiver positioned on the pivotable wall to pivot therewith. Pivoting the pivotable wall from a first position to a second position provides greater access to the first lamp receiver.

In preferred forms the first lamp receiver is also positioned on the pivotable wall to pivot therewith, there is a first lamp positioned in the first lamp receiver, a second lamp positioned in the second lamp receiver, and an electrical power supply for supplying power to the first and second lamp to facilitate illumination of the first and second lamp. The second lamp can be positioned to illuminate an area vertically above the lighting fixture, and the first lamp can be positioned to illuminate an area below the lighting fixture.

In other preferred forms the shade is in the form of an upwardly open bowl, the pivotable wall is part of an upwardly open reflector cup, the second lamp receiver is positioned in the cup, and the first lamp receiver is positioned outside the cup. In this form, the first lamp receiver can receive a lamp that essentially surrounds the cup.

In still other preferred forms the lighting fixture is in the form of a vertical wall mountable sconce. Or, the lighting fixture can be directly mounted or suspended from a ceiling surface. The lighting fixture could also be mounted to other surfaces, such as a soffit, shelf or other horizontal surface. In any case the pivotable wall of the light fixture can pivot on an essentially horizontal axis to move the wall from an essentially horizontal position to an at least partially vertically extending position.

Preferred forms of lamps for use with such fixtures are filament lamps, fluorescent lamps, high intensity discharge lamps and light emitting diodes.

In another aspect the invention provides a method for replacing a burnt-out lamp of such a lighting fixture. One pivots the pivot wall from the first position to the second position to provide greater access to the first lamp receiver, removes the burnt-out lamp and replaces it, and then returns the pivot wall to its original position.

It should be appreciated that it will not be readily apparent to those immediately below the light fixture how the interior of the device can be accessed. Thus, it is considerably more tamper-resistant than a lamp providing lamp access from below. Further, the lower shade avoids glare directed downwardly.

However, the authorized maintenance personnel can stand on a ladder or other raised platform, swing up the reflector plate on a horizontal access, and have the ability to change burnt out lower and upper lamps without requiring any special tools or any disassembly (apart from removing the lamps) of the device.

Further, this permits a single reflector plate or tray to perform double duty, without requiring extra structures to provide access to the interior of the fixture upon disassembly.

This type of single reflector and dual lamp system is suitable to be incorporated into a wide variety of light fixtures, and it (and the parts needed to affix it to such standard fixtures) can be inexpensively produced and assembled.

The lights can be of the same color, or (e.g., for Christmas) be of different colors.

These and still other advantages of the invention will be apparent from the detailed description which follow, and the accompanying drawings. These embodiments are merely preferred embodiments. Hence, the claims should be looked to in order to assess the full scope of the invention.

BRIEF DESCRIPTION OF THE DRAWINGS

FIG. 3A is an enlarged partial perspective view of one hinge connection;

FIG. 5 is a top view of the lighting fixture;

FIG. 12 is a bottom perspective view of a pendant or chandelier configuration having multiple lighting fixtures of the present invention; and FIG. 13 is a top perspective view thereof.

DETAILED DESCRIPTION OF THE PREFERRED EMBODIMENTS

Figure 1:
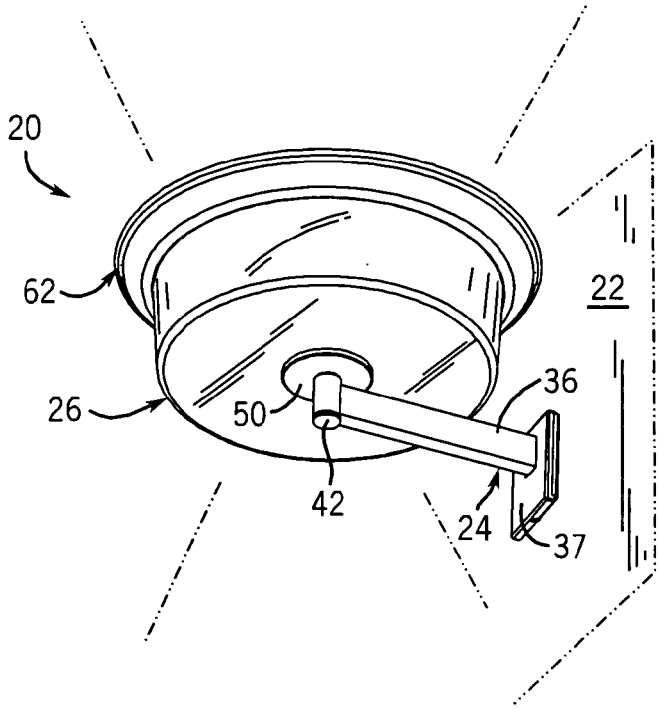
FIG. 1 is a bottom perspective view of a lighting fixture of the present invention, in the form of a wall mounted sconce.
Figure 2:
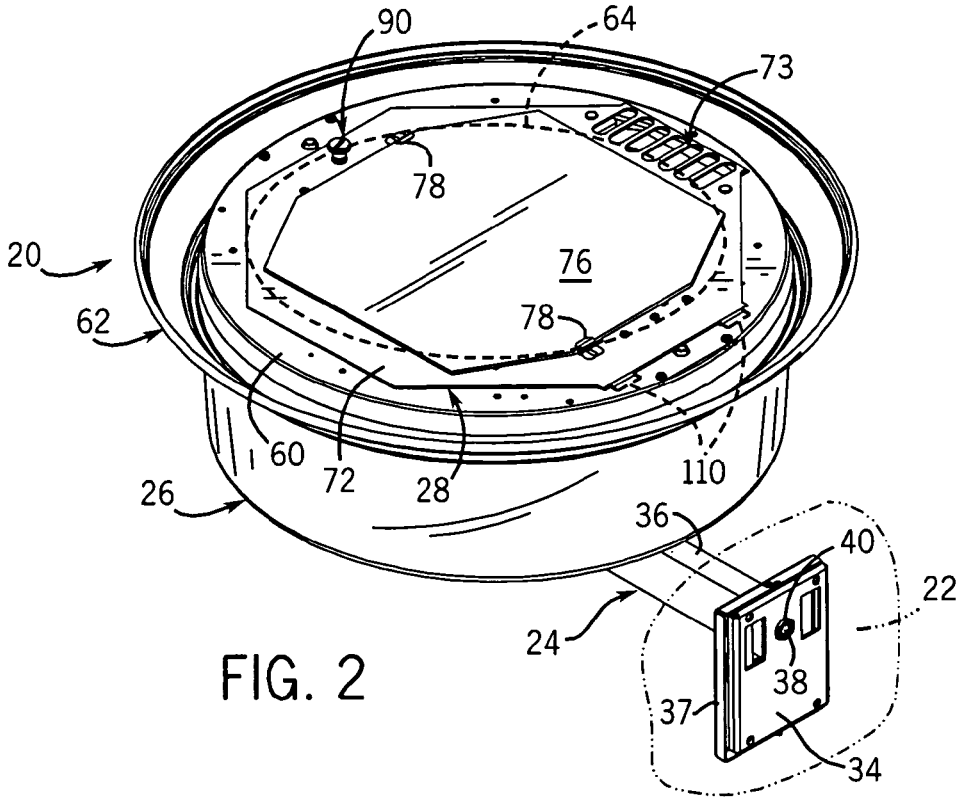
FIG. 2 is a top perspective view thereof
Figure 3:
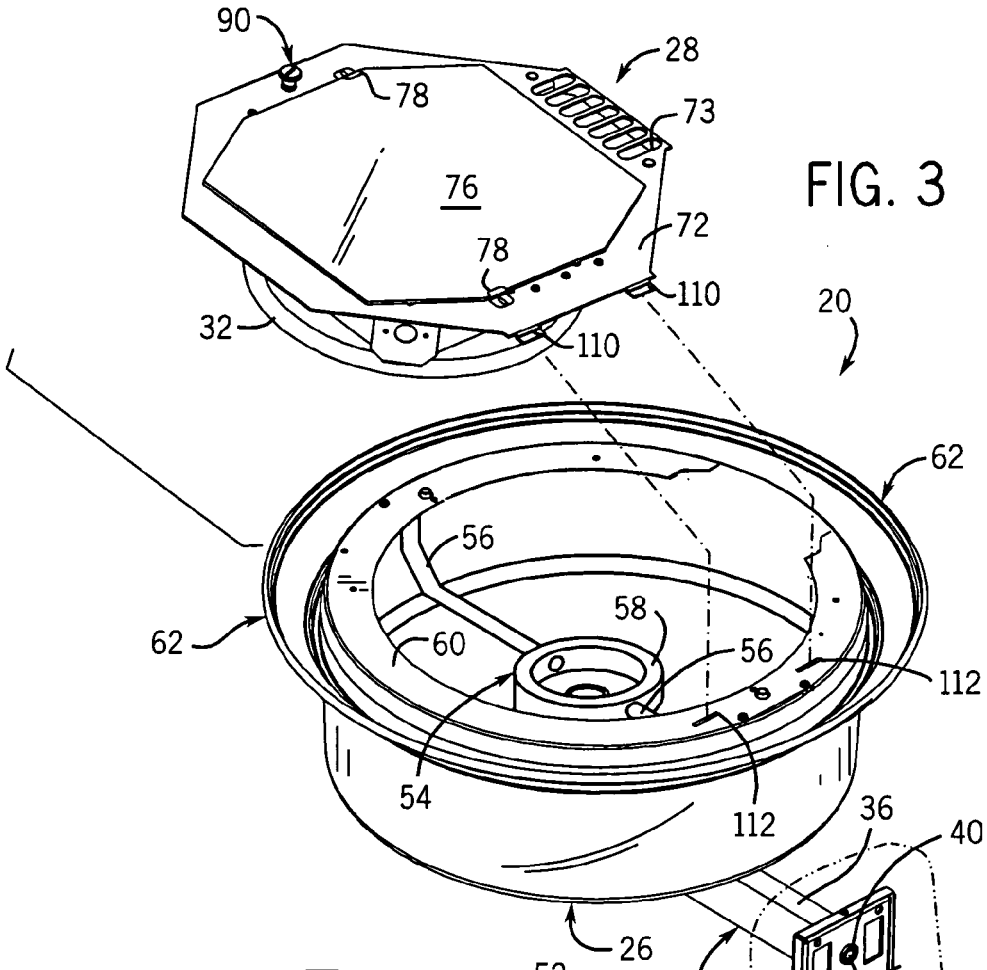
FIG. 3 is an exploded assembly view thereof showing a hinged reflector tray carrying two lamps disassembled from a refractor bowl and wall mount.
Figure 4:
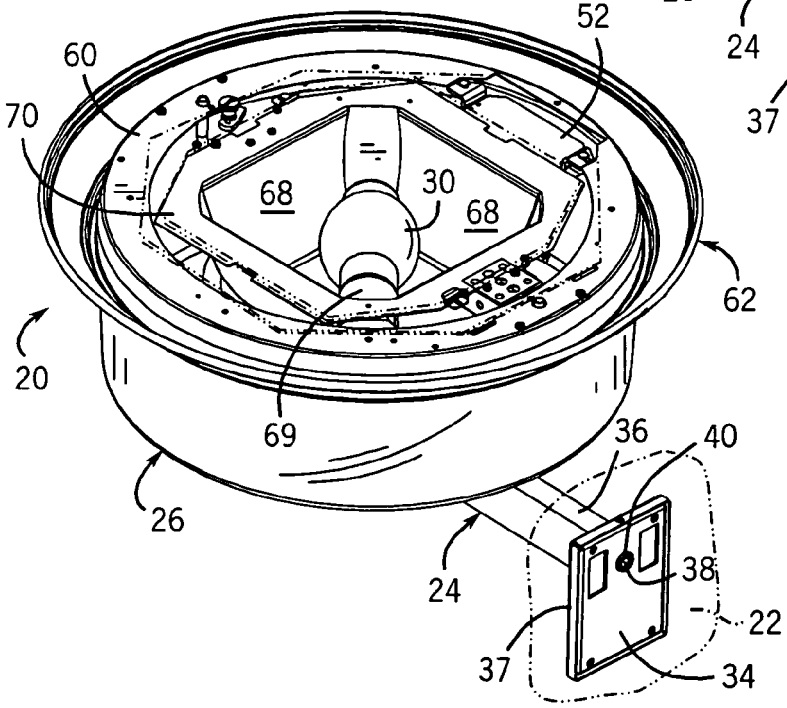
FIG. 4 is a view similar to FIG. 2 but with top and cover plates shown in phantom.

The invention provides a lighting fixture generally referred to with numeral 20. FIGS. 1 and 2 illustrate the lighting fixture 20 in a wall sconce configuration in which it is mounted to a vertical wall 22. FIGS. 12 and 13 illustrate an alternate, pendent or chandelier configuration of the lighting fixture 20A in which it is suspended from above, for example being mounted to a ceiling 22A or other horizontal wall surface, via a suspension rod 21. FIGS. 12 and 13 also show that multiple lighting fixtures (two shown) can be clustered together for increased illumination and/or to create a different aesthetic effect. While these figures show two lighting fixtures joined together and suspended by a single suspension rod, any number of lighting fixtures and suspension rods (or chains) can be joined together in any suitable configuration. Also, while not shown, a clustered wall sconce is within the scope of the invention.

Referring now to FIGS. 1–6, the lighting fixture 20 includes as primary components a fixture support 24, a refractor bowl 26 and a reflector tray 28. The reflector tray 28 holds an up lamp 30 and a down lamp 32 for illuminating a space above and below the lighting fixture 20, respectively. The refractor bowl 26 can be any shape, but must be made at least in part of a light transmissive material, either transparent or translucent, for example glass or acrylic. While a bowl configuration is preferred because it encloses the bottom side of the lighting fixture, the bowl could be replaced by an open bottomed shade made of a reflective or opaque material with little or no refractive properties. Note also that the terms "up" and "down" are used herein for simplicity to describe a preferred embodiment of the lighting fixture in which two lamps are intended to illuminate space above and below the supporting structures of the lighting fixture. It is within the scope of the invention for the lighting fixture to provide illumination directed in one or more sideways directions, for example, horizontally or at some oblique angle.

Also, the up lamp 30 of the preferred embodiment is a high intensity discharge metal halide lamp in a bulb configuration and the down lamp 32 is a T5 circleline fluorescent lamp. However, any suitable light source can be used for either lamp, including for example incandescent, compact fluorescent, halogen, xenon and light emitting diode light sources. Any suitable bulb, tube or ring configuration can also be used with the lighting fixture of the present invention.

The fixture support 24 has a mounting bracket 34 that fastens to the wall 22 to mount a horizontal support arm 36 and cover plate 37. The support arm 36 is hollow and has an internal conduit 38 leading from an opening 40 in the bracket 34 to a terminus 42 located at the center of the refractor bowl 26. The terminus 42 defines a right angle channel 44 receiving the conduit 38 and a cylindrical piece 46 threaded into the vertical leg of the channel 44 and disposed in openings in a decorative washer 50 and the center of the refractor bowl 26. This arrangement allows wiring to be routed discretely through the opening 40 in the bracket 34, through the conduit 38, bend up through the channel 44 and through piece 46 to the interior of the lighting fixture 20. Before connecting to the lamps 30 and 32, the electrical wires run into a splice box 51 through a strain relief member (not shown) meeting UL standards for movable wires. Wires for the down lamp 32 connect to a ballast 52. Wires for the up lamp 30 run through the splice box 51 from a remote ballast (not shown) located behind the wall.

Cylindrical piece 46 also mounts a yoke member 54 with two bent arms 56 extending from opposite sides of a hub member 58. The ends of the arms 56 fit into openings in an annular flange 60 of a decorative trim ring 62 which extends around the upper periphery of the refractor bowl 26. The annular flange 60 defines a circular opening 64 allowing the reflector tray 28 to fit recessed down into the interior of the refractor bowl 26, thereby being enclosed and not readily touched or tampered with by unauthorized personnel.

Figure 6:
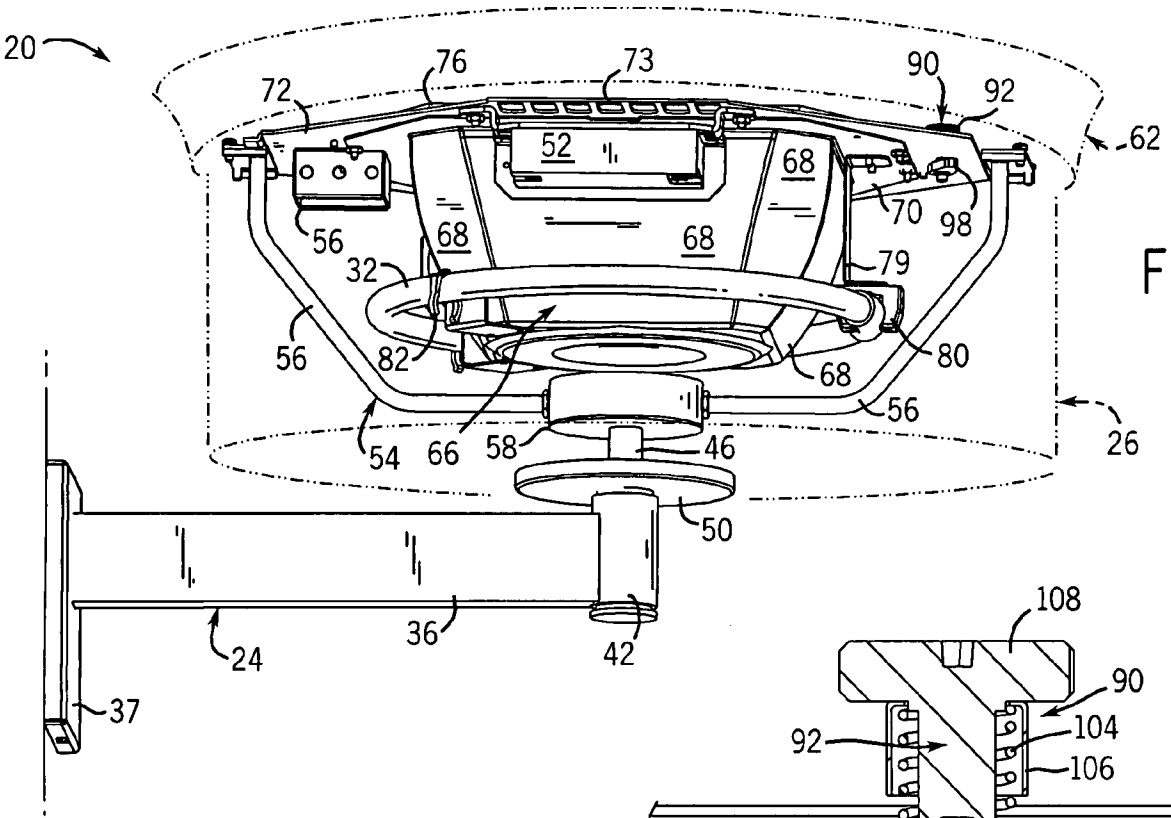
FIG. 6 is a side perspective view showing the refractor bowl in phantom.
Figure 10:
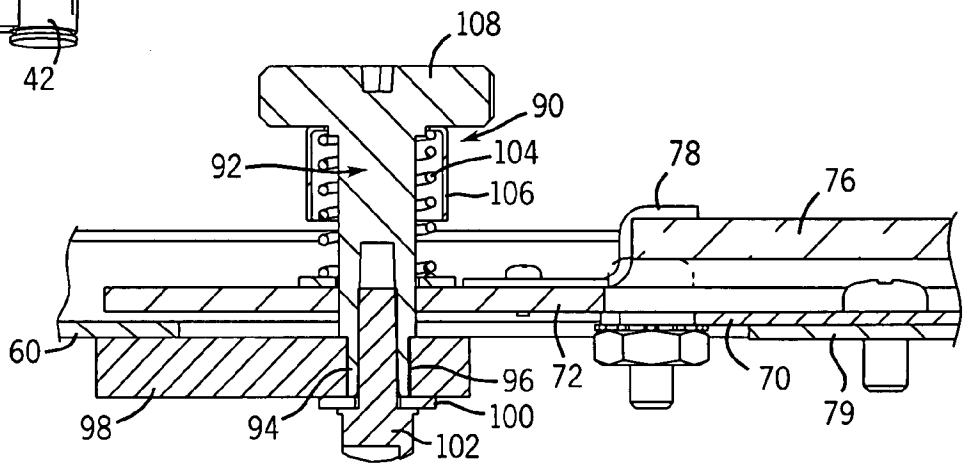
FIG. 10 is an even more enlarged partial sectional view of the latch mechanism.
Figure 7:
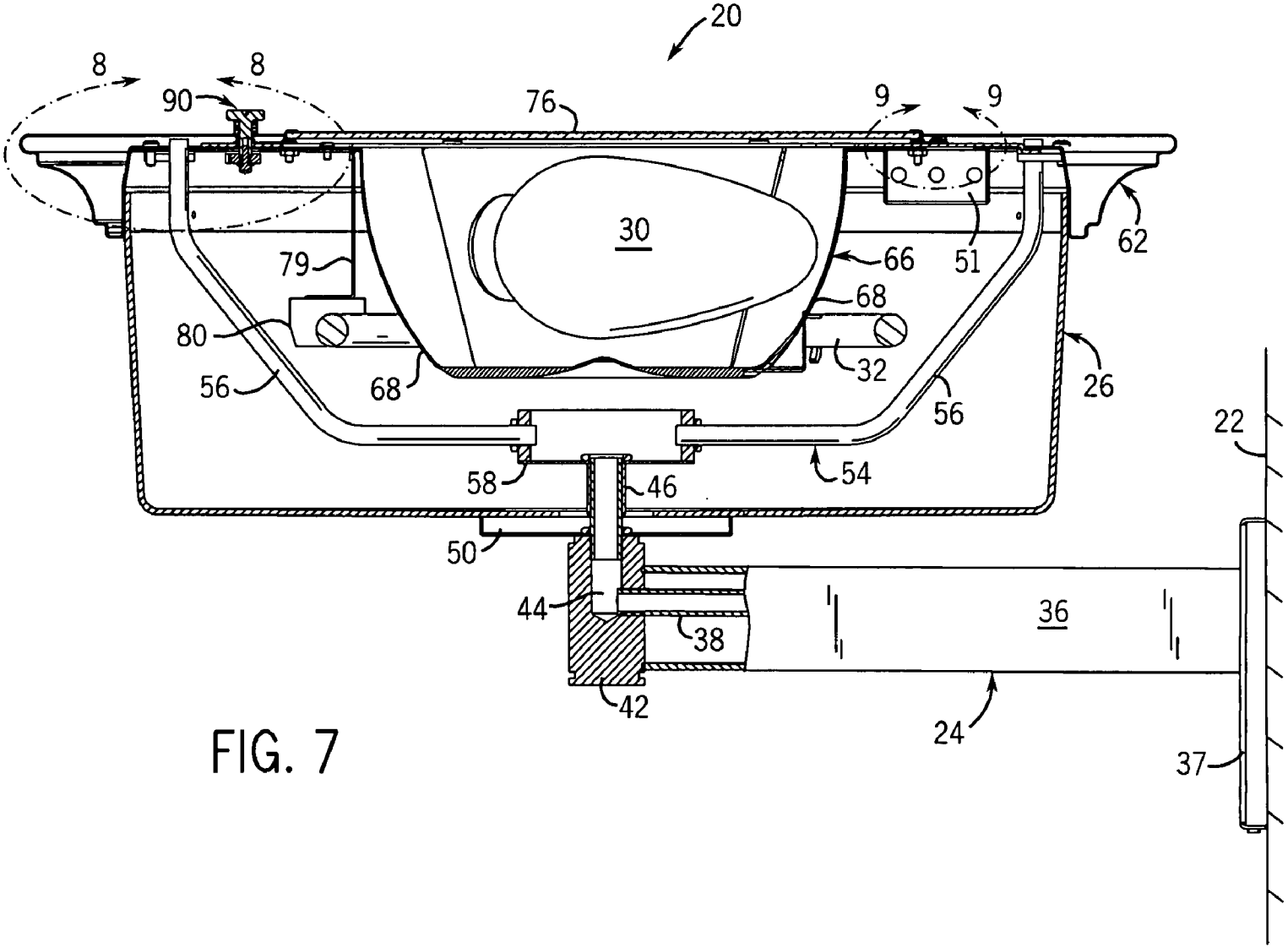
FIG. 7 is a sectional view taken along line 7—7 of FIG. 5.
Figure 8:
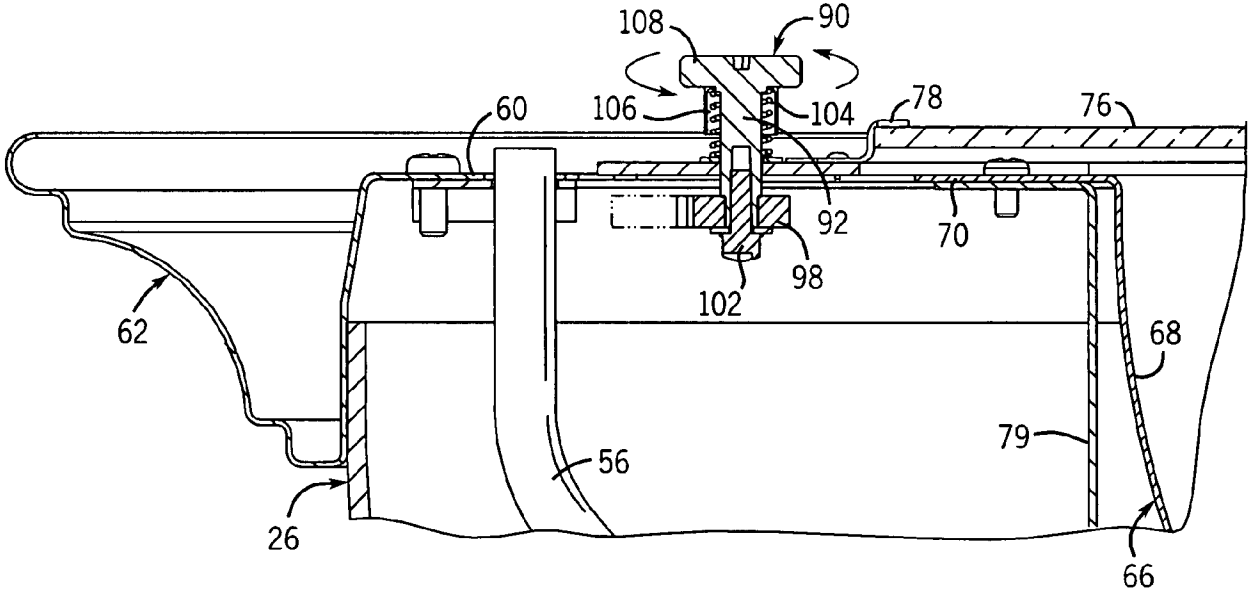
FIG. 8 is an enlarged partial sectional view taken along arc 8—8 of FIG. 7 showing a latch mechanism for the top cover.
Figure 9:
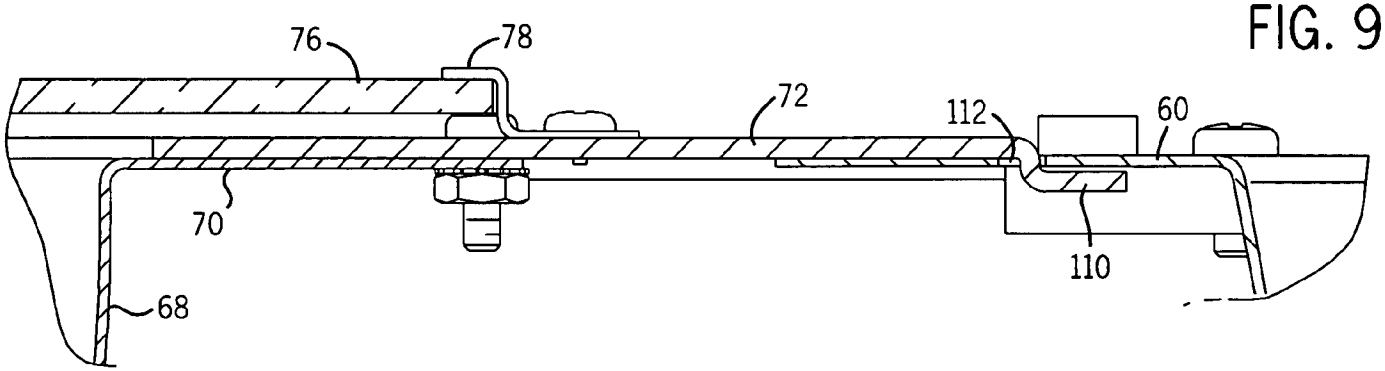
FIG. 9 is an enlarged partial sectional view taken along arc 9—9 of FIG. 7 showing the hinge connection.
Figure 11:
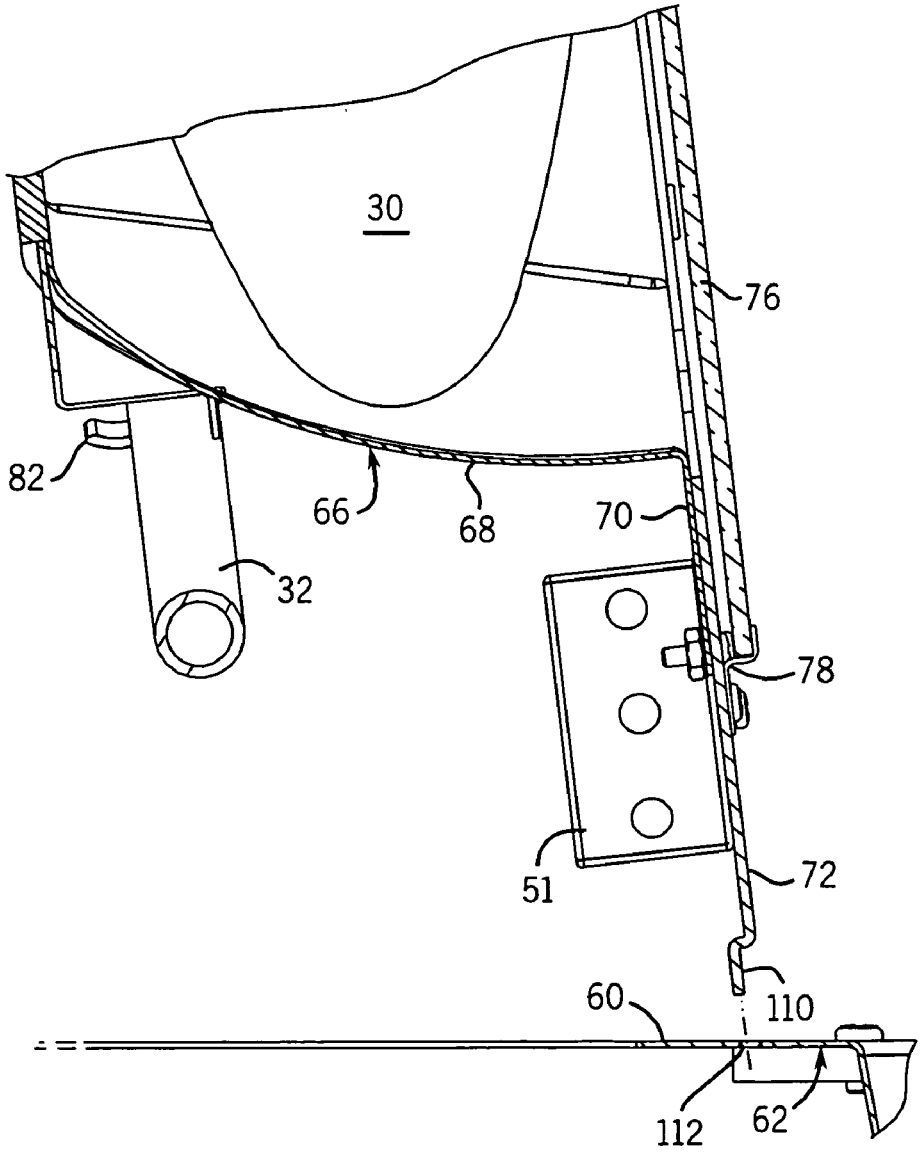
FIG. 11 is another partial sectional view showing the hinge connection with the reflector tray disassembled.

As shown in FIGS. 6 and 9, the reflector tray 28 has a cup 66 with multiple partially spherical side walls 68 made of a material having, or treated to have, a light reflective surface at the inner faces (and to some degree the outer faces) of the walls. A polished anodized aluminum is one suitable material. The walls 68 (and reflective surface) of the cup 66 isolate the light from the lamps 30 and 32. The up lamp 30, shown as an HID metal halide lamp in FIGS. 4 and 7, and its electric socket/lamp receiver 69 (see FIG. 4) are housed within the interior of the cup 66. The walls 68 of the cup 66 have an upper flange 70 that is fastened to a top plate 72. The top plate 72 has an opening 74 in the center and a generally octagonal outer periphery sized larger than the opening 64 in the annular flange 60 so that it overlaps the annular flange 60 and supports the cup 66. The top plate 72 has a vent section 73 for cooling the ballast 52. A cover plate 76 mounts onto of the top plate 72 by two clips 78 to cover the opening 74 in the top plate 72. The cover plate 76 can be removed to access the up lamp 30 by loosening the fasteners securing the clips 78. The cover plate 76 can be made of glass or other light transmissive material, either transparent or translucent, so that light from the up lamp 30 can pass through it. A vertical hanger 79 is mounted to the tray flange 70 holding a socket/lamp receiver 80 for the down lamp 32 which is electrically connected to the ballast 52. The hanger 79 and socket 80 retain the down lamp 32 around the periphery of the cup 66, and the socket has electrical contacts allowing for quick plug-in connection for installation and replacement. Retaining clips 82 support the down lamp 32 at other locations.

As shown in FIGS. 6, 7, 8 and 10, the reflector tray 28 is ordinarily latched to the fixture by a spring biased latch 90 mounted to the top plate 72. The latch 90 has a thumb screw 92 that fits through an opening in the top plate 72 and defines a key section 94 that is received in a keyway 96 of a catch member 98 held onto the thumb screw 92 by a washer 100 and fastener 102. A spring 104 is disposed about the shaft of the thumb screw 92 within a sleeve 106 and acts against the top plate 72 and a head 108 of the thumb screw 92. When the latch 90 is in the position shown in FIG. 10 it engages the underside of the annular flange 60 so to latch the reflector tray 28. By turning the thumb screw 92 a quarter turn or more the catch member 98 will rotate away from and clear the annular flange 60 so that the reflector tray can be pivoted upwardly, as described below.

As shown in FIGS. 3, 3A, 9 and 11, the top plate 72 of the reflector tray 28 has two spaced apart bent prongs 110 that fit into spaced slots 112 of the annular flange 60. This arrangement provides a hinged connection of the reflector tray 28 to the annular flange 60 specifically, and the rest of the lighting fixture 20 generally. The reflector tray 28 can pivot from its resting position upwardly in the slots 112.

The hinged connection makes installation and maintenance of the lamps 30 and 32 quick and efficient, particularly for the enclosed down lamp 32. Turning the thumb screw 92 releases the latch and allows the reflector tray 28 to be swung upwardly, for example, to a near vertical position. This raises the down lamp 32 out of the refractor bowl 26 and allows it to be unplugged from its socket (and clips) from the side. Once the down lamp 32 is replaced, the reflector tray 28 can be swung down and re-secured by the latch 90. The up lamp 30 can be accessed with the reflector tray 28 in either position by loosening the clips 78 and removing the cover plate 74.

Many modifications, such as the use of various lamp types, clustering arrangements or mounting configurations, may be made to the preferred embodiments without departing from the scope and spirit of the claims. For example, rather than the pivoting structure being a recessed or cup-shaped tray, it could be generally flat, and preferably coated or otherwise prepared with one or more reflective surfaces for reflecting light from the up lamp and/or the down lamp. Thus, the claims should be looked to in order to judge the full scope of the invention.

INDUSTRIAL APPLICABILITY

The invention provides a lighting fixture capable of providing improved maintenance access to the lamps used with the fixture.

What is claimed is:

1. A lighting fixture, comprising:

a fixture support;

a shade supported by the fixture support;

a pivotal wall;

a first lamp receiver positioned on the pivotable wall adjacent the shade so that light can be projected beyond the shade if a lamp is placed in the first lamp receiver and that lamp is supplied with power; and a second lamp receiver positioned on the pivotable wall to pivot therewith;

wherein pivoting the pivotable wall from a first position to a second position provides greater access to the first lamp receiver.

2. The lighting fixture of claim 1, further comprising a first lamp positioned in the first lamp receiver, a second lamp positioned in the second lamp receiver, and an electrical power supply for supplying power to the first and second lamp to facilitate illumination of the first and second lamp.

3. The lighting fixture of claim 2, wherein the second lamp is positioned to illuminate an area vertically above the lighting fixture, and the first lamp is positioned to illuminate an area below the lighting fixture.

4. The lighting fixture of claim 1, wherein the shade is in the form of an upwardly open refractive bowl.

5. A lighting fixture, comprising:

a fixture support;

a shade supported by the fixture support;

a first lamp receiver positioned adjacent the shade so that light can be projected beyond the shade if a lamp is placed in the first lamp receiver and that lamp is supplied with power;

a pivotable wall positioned over the first lamp receiver; and a second lamp receiver positioned on the pivotable wall to pivot therewith;

wherein pivoting the pivotable wall from a first position to a second position provides greater access to the first lamp receiver;

wherein the pivotable wall is part of an upwardly open reflector cup, the second lamp receiver is positioned in the cup, and the first lamp receiver is positioned outside the cup.

6. The lighting fixture of claim 5, wherein the first lamp receiver receives a lamp that essentially surrounds the cup.

7. A lighting fixture, comprising:

a fixture support;

a shade supported by the fixture support;

a first lamp receiver positioned adjacent the shade so that light can be projected beyond the shade if a lamp is placed in the first lamp receiver and that lamp is supplied with power;

a pivotable wall positioned over the first lamp receiver; and a second lamp receiver positioned on the pivotable wall to pivot therewith;

wherein pivoting the pivotable wall from a first position to a second position provides greater access to the first lamp receiver;

wherein the lighting fixture is in the form of a wall mountable sconce.

8. The lighting fixture of claim 1, wherein the lighting fixture is in the form of a ceiling mountable light unit.

9. The lighting fixture of claim 1, wherein the pivotable wall can pivot on an essentially horizontal axis to move the wall from an essentially horizontal position to an at least partially vertically extending position.

10. The lighting fixture of claim 1, further comprising first and second lamps positionable in the first and second lamp receivers respectively, the lamps being selected from the group consisting of filament lamps, fluorescent lamps, high intensity discharge lamps and light emitting diodes.

11. A method for replacing a burnt-out lamp of a lighting fixture, comprising:

obtaining the lighting fixture of claim 10;

pivoting the pivot wall thereof from the first position to the second position to provide greater access to the first lamp receiver;

removing a lamp from the first lamp receiver;

placing another lamp into the first lamp receiver; and pivoting the pivot wall from the second position back to the first position.

* * * * *